United States Patent [19]

Wright et al.

[11] Patent Number: 4,858,754

[45] Date of Patent: Aug. 22, 1989

[54] MOLDING APPARATUS AND CONSTRUCTION OF CONTACT LENS CASE

[75] Inventors: David Wright, Guntersville; Richard Rabenau, Arab, both of Ala.

[73] Assignee: Ryder International Corporation, Arab, Ala.

[21] Appl. No.: 203,275

[22] Filed: Jun. 7, 1988

[51] Int. Cl.[4] ..... A45C 13/10
[52] U.S. Cl. ..... 206/5.1
[58] Field of Search ..... 206/5.1

[56] References Cited

U.S. PATENT DOCUMENTS

| | | | |
|---|---|---|---|
| 4,415,076 | 1/1983 | Campbell | 206/5.1 |
| 4,684,014 | 8/1987 | Davenport | 206/5.1 |
| 4,782,946 | 11/1988 | Pollak | 206/5.1 |

*Primary Examiner*—Joseph Man-Fu Moy
*Attorney, Agent, or Firm*—R. A. Giangiorgi

[57] ABSTRACT

A molded receptacle for containment of a contact lens or the like, comprises: an open mouth, cup-shaped body having a generally annular, upstanding body wall and a curved rim formed on an upper end of the body wall to define the open mouth, and wherein the radially outer surface of the body wall includes a remnant flash material formation which is located below the rim.

2 Claims, 1 Drawing Sheet

MOLDING APPARATUS AND CONSTRUCTION OF CONTACT LENS CASE

BACKGROUND OF THE INVENTION

This invention related to molding apparatus for open-mouth receptacles, and more particularly relates to molding apparatus for improved construction of receptacles such as contact lens cases.

Plastic molding methods, particularly injection molding have been developed for molding open-mouthed receptacles such as contact lens storage cases. Commercially, dual storage receptacles have been molded in a unitary side by side construction provided with separate threaded caps. Typically, a core pin has been used to shape the cavity and rim of the open-mouthed lens case receptacle. In the molding operation, a sharp edge of plastic flashing could be produced around the core pin and formed at the rim of the receptacle which sometimes resulted in damage to the contact lenses during sliding removal against the rim of the receptacle.

SUMMARY OF THE INVENTION

In accordance with this invention improved molding apparatus enables molding of an open-mouthed, cup-shaped receptacle particularly for use with contact lenses in which the rim portion of the receptacle is smooth and free of any sharp edged flash material. The improved molding apparatus includes a mold element to shape the upstanding wall of the receptacle cup, and a molding core which is removably insertable into the mold element to shape the cavity and rim of the cup. The core includes a peripheral portion which is engageable against the mold element to define a mold parting line on the radially outer surface of the cup wall below the rim in order to ensure that any flash material created at the parting line is sufficiently spaced from the cup rim to eliminate hazard to the lenses by the flash.

DETAILED DESCRIPTION OF THE ILLUSTRATED EMBODIMENT

Figure 1:
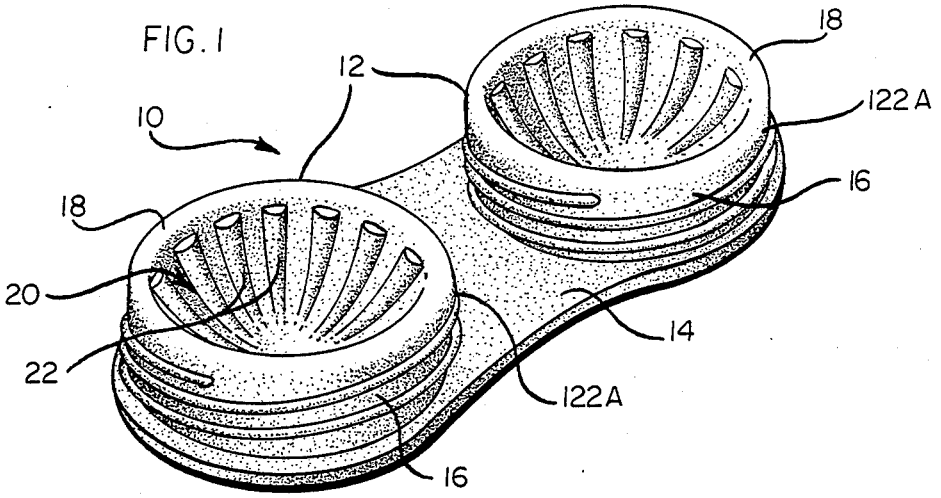
FIG. 1 is a perspective view of a dual-cup contact lens receptacle in one embodiment according to the invention.
Figure 3:
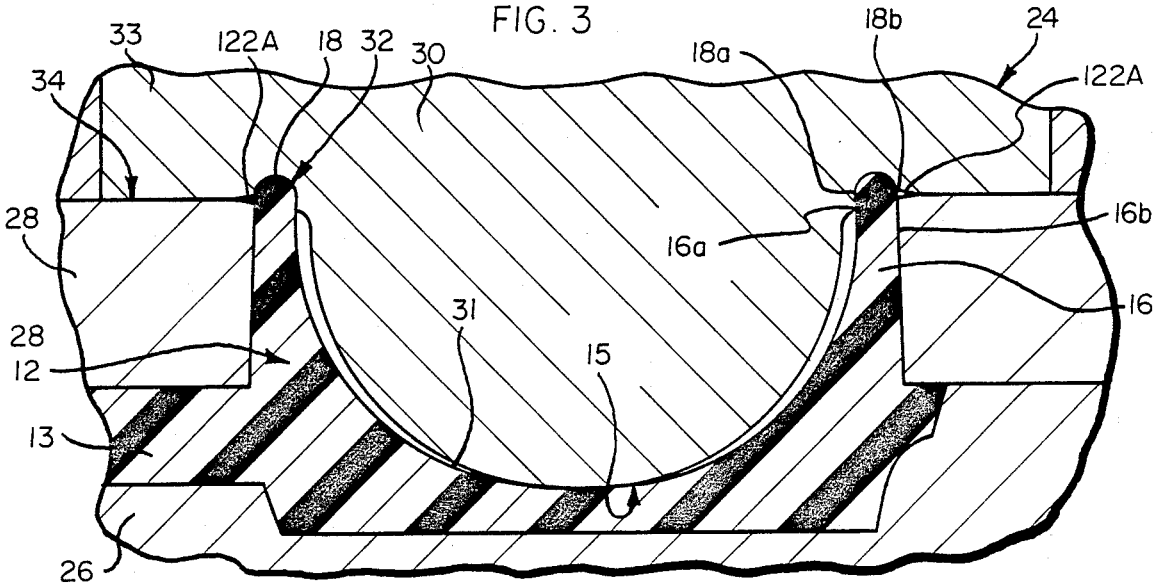
FIG. 3 is a sectional view similar to FIG. 2 but illustrating the receptacle of FIG. 1 and the configuration of an embodiment of the molding apparatus according to the invention.

Referring to FIG. 1, an integrally molded contact lens case having dual cups or receptacles in accordance with this invention is designated generally by a reference character 10. The two lens cups 12, 12 are joined by a web 14. Each of the cups 12 has an upstanding, annular wall 16 which is externally threaded to mate with a threaded cap (not shown). The wall 16 has an upper rim 18 which has a smoothly arcuate surface, so that the cross-sectional profile of the rim 18, as shown in FIG. 3. The radially inner and outer surfaces of the rim

18*a* and 18*b* tangentially join the respective radially inner and outer surfaces 16*a* and 16*b* of the wall 16.

Figure 2:
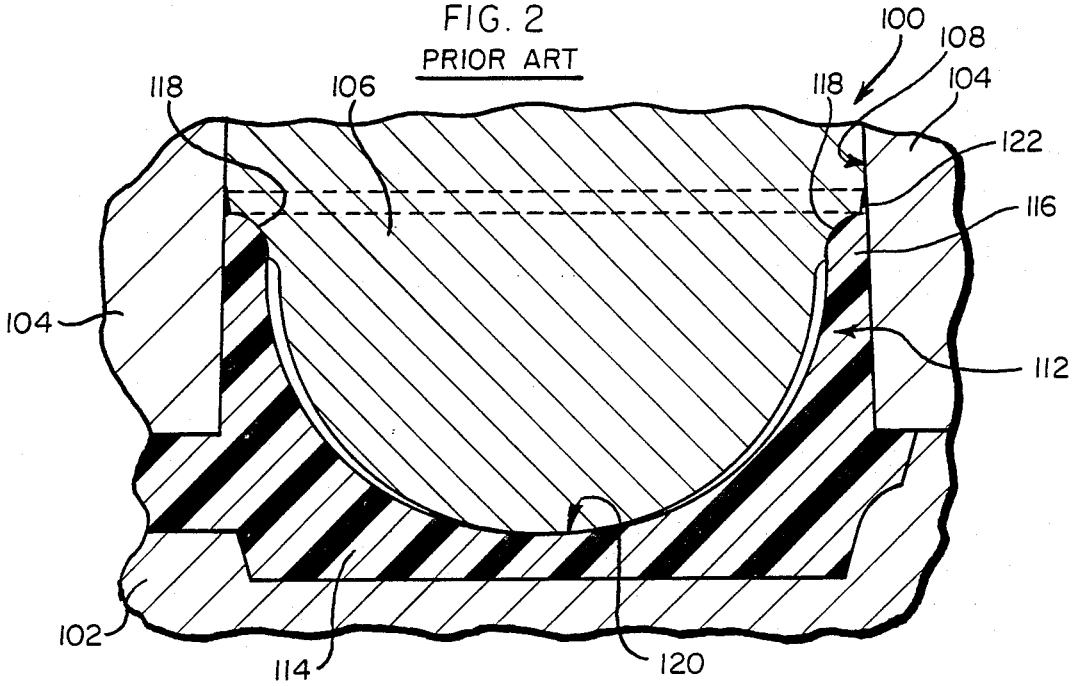
FIG. 2 PRIOR ART
FIG. 2 is a sectional view of a prior art contact lens receptacle showing the configuration of the molding apparatus.

Referring to FIG. 2 a prior art type of contact lens cup 112 is shown with the associated mold components generally designated by a reference character 100. A mold plate 102 retains and shapes the bottom wall 114 of the cup 112. An annular, bank mold component 104 retains and shapes the cup wall 116. A molding core 106 is inserted within the annular bank component 104 and projects downwardly to shape the rim 118 and the cavity 120 of the cup 112. Because the parting line 108 between the bank element 104 and the core pin 106 extends from the rim 118, the molding operation can result in flash material extending from the rim 118 as a sharp annular edge 122 directed along the parting line 108 and extending from rim 118. The sharp edge 122 would require a prohibitive separate machining operation to move. As a result, the sharp edge 122 can remain on the rim 118 as a hazard to the contact lens which is removed from the cup 112 by sliding the lens outwardly over the rim 118 and possibly engaging the sharp edge 122.

Referring again to FIG. 3, the cups 12 of the present invention are molded using mold components generally designated by mold 24. The mold components 24 include a plate 26 which shapes the bottom wall 13 of the cup 12. An annular bank component 28 has an annular configuration which surrounds and shapes the upstanding cup wall 16. The bank mold 28 does not extend above the cup rim 18. A core pin 30 is inserted through the mold bank 28, and has a convex dome shaped portion 31 which shapes the cup cavity 15 and in addition the core pin 30 has an annular, concave ring 32 which provides the entirely curved surface of the rim 18. In addition, the core pin 30 includes a peripheral portion 33 which annularly projects downwardly below the concave portion 32 and rim 18 and engages the mold bank 28 along a radially extending annular portion of a plane which is shown in cross section as the parting line 34.

The orientation of the plane and parting line 34 laterally directed and located below the rim 18 ensures that any flash material 122A which may result from the molding operation extends from the outer cylindrical surface 16*b* of the cup wall 16 well below the rim 18. As such there is no hazard in sliding a contact lens over the rim during its removal from the cup, as any sharp edge is disposed below the rim and the chances of damaging a lens during removal is substantially reduced over the prior art type of case of FIG. 2.

In light of the foregoing description of an embodiment of the molded receptacle and molding apparatus, modifications will be evident to those skilled in the art and are within broad scope of the appended claims.

The invention is claimed as follows:

1. A molded receptacle for containment of a contact lens or the like, comprising: an open mouth, cup-shaped body having a generally annular, upstanding body wall and a curved rim formed on an upper end of said body wall to define said open mouth, and wherein the radially outer surface of said body wall includes a remnant flash material formation which is located below said rim.

2. The receptacle according to claim 1 wherein said rim is at least partially defined by an arcuate surface tangentially joining said radially outer surface of said body wall which is cylindrical.

* * * * *